US009835346B2

(12) United States Patent
Kim et al.

(10) Patent No.: US 9,835,346 B2
(45) Date of Patent: Dec. 5, 2017

(54) AIR CONDITIONER AND METHOD FOR CONTROLLING THE SAME

(71) Applicant: SAMSUNG ELECTRONICS CO., LTD., Suwon-si (KR)

(72) Inventors: Kyung Hoon Kim, Suwon (KR); Se-Won Kim, Seoul (KR); Byoung Guk Lim, Suwon (KR); Il Yong Cho, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 331 days.

(21) Appl. No.: 14/640,629

(22) Filed: Mar. 6, 2015

(65) Prior Publication Data

US 2015/0267932 A1 Sep. 24, 2015

(30) Foreign Application Priority Data

Mar. 18, 2014 (KR) ..... 10-2014-0031423

(51) Int. Cl.

*F25B 13/00* (2006.01)
*F25B 49/02* (2006.01)
*F24F 11/00* (2006.01)

(52) U.S. Cl.

CPC ..... *F24F 11/001* (2013.01); *F24F 11/008* (2013.01); *F25B 13/00* (2013.01); *F25B 49/02* (2013.01); *F24F 2011/0046* (2013.01); *F25B 2313/006* (2013.01); *F25B 2313/0233* (2013.01); *F25B 2313/0293* (2013.01); *F25B 2313/02741* (2013.01); *F25B 2313/0314* (2013.01); *F25B 2313/0315* (2013.01); *F25B 2400/13* (2013.01); *F25B 2500/08* (2013.01); *F25B 2600/11* (2013.01); *F25B 2600/2509* (2013.01); *F25B 2700/1931* (2013.01); *F25B 2700/1933* (2013.01)

(58) Field of Classification Search

CPC ..... F25B 2313/0312; F25B 2313/0314; F25B 2313/0315; F25B 2500/08; F25B 2600/112; F24F 11/008

USPC ..... 62/180, 199, 200

See application file for complete search history.

(56) References Cited

U.S. PATENT DOCUMENTS

| | | | | |
|---|---|---|---|---|
| 4,671,075 A * | 6/1987 | Iijima | F25B 1/00 | 62/196.1 |
| 4,770,000 A * | 9/1988 | Kuroda | F25B 13/00 | 62/156 |
| 2006/0123815 A1* | 6/2006 | Kim | F24F 3/065 | 62/200 |

FOREIGN PATENT DOCUMENTS

| | | |
|---|---|---|
| EP | 1 862 745 A2 | 12/2007 |
| EP | 2 410 257 A1 | 1/2012 |
| EP | 2 410 265 A1 | 1/2012 |
| WO | 2012/172599 A1 | 12/2012 |

OTHER PUBLICATIONS

Extended European Search Report dated Aug. 26, 2015 in corresponding European Patent Application No. 15157740.0.

* cited by examiner

*Primary Examiner* — Marc Norman
(74) *Attorney, Agent, or Firm* — Staas & Halsey LLP

(57) ABSTRACT

The present disclosure provides an air conditioner. The air conditioner includes a compressor; a sensor for measuring the compressors state configured to detect compressor state information that includes at least one of a pressure value and a saturation temperature of the compressor; and a controller configured to control air flow on the side of an indoor unit by comparing the compressor state information measured from the sensor and a threshold.

21 Claims, 5 Drawing Sheets

AIR CONDITIONER AND METHOD FOR CONTROLLING THE SAME

CROSS-REFERENCE TO RELATED APPLICATION(S)

This application claims the benefit under 35 U.S.C. §119 (a) of a Korean patent application filed on Mar. 18, 2014 in the Korean Intellectual Property Office and assigned Serial No. 10-2014-0031423, the entire disclosure of which is incorporated hereby incorporated by reference.

TECHNICAL FIELD

The present disclosure relates to an air conditioner and method for controlling the same.

BACKGROUND

A/C is an abbreviation for Air Conditioner, meaning a device used for cooling or heating indoor space. Refrigerant fluid absorbs surrounding heat during evaporation, and this property is used for cooling. On the contrary, the property that refrigerant gas discharges heat during liquefaction is used for heating.

It is common for an A/C to have a single indoor unit connected to a single outdoor unit, but recently, the demand for a system A/C with a single outdoor unit connected to multiple indoor units having various forms and capacities has been increasing. The system A/C with an outdoor unit connected to multiple indoor units may be optimally designed to fit for building types and characteristics of respective rooms and may efficiently use indoor and/or outdoor space, thereby being installed in schools, government offices, hospitals, commercial buildings, studio apartments, apartment houses, shopping malls, offices, etc.

Multi split A/C systems having capacity-variable compressors mounted thereon are becoming more common, and Variable Refrigerant Flow (VRF) systems having functions varying with indoor loads are also increasingly used. Such systems have an advantage of enabling rapid cooling and/or heating by increasing capacity as required.

In the meantime, a need exists for a technology for the A/C to actively deal with a change in load state for a compressor in a high temperature region.

SUMMARY

The present disclosure provides an air conditioner and method for controlling the same to adjust overall refrigerant flow rate by regulating set air flow of an indoor unit based on a pressure range of a compressor during protection control of the compressor.

In accordance with an aspect of the present disclosure, an air conditioner is provided. The air conditioner includes a compressor; a sensor for measuring the compressor's state configured to detect compressor state information that includes at least one of a pressure value and a saturation temperature of the compressor; and a controller configured to control air flow on the side of an indoor unit by comparing the compressor state information measured from the sensor and a threshold.

The controller may control subcooling control mode according to a result of comparing the compressor state information and the threshold.

If a pressure value of the compressor is detected by the sensor measuring suction pressure and discharge pressure of the compressor, the controller may control air flow on the side of an indoor unit by comparing the pressure value of the compressor measured from the sensor with a pressure threshold.

The controller may adjust the air flow on the side of the indoor unit to a necessary air flow for now and turn off the subcooling control mode, if the pressure value of the compressor has exceeded a first pressure threshold in a dangerous range for a predetermined time.

If the pressure value of the compressor has been less than a second pressure threshold in the maintenance range for a predetermined time since the controller adjusted the air flow on the side of the indoor unit to a necessary air flow for now and turned off the subcooling control mode, the controller may adjust the air flow on the side of the indoor unit to a set air flow and keep on turning off the subcooling control mode.

If the pressure value of the compressor has been less than a third pressure threshold in a normal range for a predetermined time since the controller adjusted the air flow on the side of the indoor unit to a set air flow and kept on turning off the subcooling control mode, the controller 130 may turn on the subcooling control mode.

If the sensor measures a saturation temperature, the controller may control air flow on the side of an indoor unit by comparing the saturation temperature measured from the sensor with a temperature threshold.

The controller may adjust the air flow on the side of the indoor unit to a necessary air flow for now and turn off the subcooling control mode, if the saturation temperature has exceeded a first temperature threshold in a dangerous range for a predetermined time.

The controller may adjust the air flow on the side of the indoor unit to a set air flow and keep on turning off the subcooling control mode, if the saturation temperature has been less than a second temperature threshold in a maintenance range for a predetermined time since the air flow on the side of the indoor unit was adjusted to the necessary air flow for now and the subcooling control mode was turned off.

The controller may turn on the subcooling control mode, if the saturation temperature has been less than a third temperature threshold in a normal range for a predetermined time since the air flow on the side of the indoor unit was adjusted to the set air flow and the subcooling control mode was kept being turned off.

The air flow on the side of the indoor unit may comprise a user-set air flow manipulated by a user and an initially-set air flow set in initially setting the indoor unit, and the controller may control at least one of the user-set air flow and initially-set air flow in regulating the air flow on the side of the indoor unit.

In accordance with another aspect of the present disclosure, a method of controlling an air conditioner is provided. The method includes operating compressor protection mode; detecting compressor state information that includes at least one of a pressure value and a saturation temperature of a compressor; and controlling air flow on the side of an indoor unit by comparing the compressor state information with a threshold.

Controlling air flow on the side of an indoor unit may include controlling subcooling control mode according to a result of comparing the compressor state information and the threshold.

If the compressor state information is a pressure value of the compressor obtained by measuring suction pressure and discharge pressure of the compressor, controlling air flow on the side of an indoor unit may include determining whether the pressure value of the compressor has exceeded a first pressure threshold in a dangerous range for a predetermined time; and adjusting the air flow on the side of the indoor unit to a necessary air flow for now and turning off the subcooling control mode, if it is determined that the pressure value of the compressor has exceeded the first pressure threshold for the predetermined time.

The method further includes, after adjusting the air flow on the side of the indoor unit to a necessary air flow for now and turning off the subcooling control mode, determining whether the pressure value of the compressor has been less than a second pressure threshold in a maintenance range for a predetermined time; and adjusting the air flow on the side of the indoor unit to a set air flow and keeping on turning off the subcooling control mode, if it is determined that the pressure value of the compressor has been less than the second pressure threshold for the predetermined time.

The method further includes, after adjusting the air flow on the side of the indoor unit to the set air flow and keeping on turning off the subcooling control mode, determining whether the pressure value of the compressor has been less than a third pressure threshold in a normal range for a predetermined time; and turning on the subcooling control mode, if it is determined that the pressure value of the compressor has been less than the third pressure threshold for the predetermined time.

If the compressor state information is a saturation temperature, controlling air flow on the side of an indoor unit may include determining whether the saturation temperature has exceeded a first temperature threshold in a dangerous range for a predetermined time; and adjusting the air flow on the side of the indoor unit to a necessary air flow for now and turning off the subcooling control mode, if it is determined that the saturation temperature has exceeded the first temperature threshold for the predetermined time.

The method further includes, after adjusting the air flow on the side of the indoor unit to a necessary air flow for now and turning off the subcooling control mode, determining whether the saturation temperature has been less than a second temperature threshold in a maintenance range for a predetermined time; and adjusting the air flow on the side of the indoor unit to a set air flow and keeping on turning off the subcooling control mode, if it is determined that the saturation temperature has been less than the second temperature threshold for the predetermined time.

The method further includes, after adjusting the air flow on the side of the indoor unit to the set air flow and keeping on turning off the subcooling control mode, determining whether the saturation temperature has been less than a third temperature threshold in a normal range for a predetermined time; and turning on the subcooling control mode, if it is determined that the saturation temperature has been less than the third temperature threshold for the predetermined time.

The air flow on the side of the indoor unit may include a user-set air flow manipulated by a user and an initially-set air flow set in initially setting the indoor unit, and controlling air flow on the side of an indoor unit may include control at least one of the user-set air flow and initially-set air flow in regulating the air flow on the side of the indoor unit.

Other aspects, advantages, and salient features of the disclosure will become apparent to those skilled in the art from the following detailed description, which, taken in conjunction with the annexed drawings, discloses exemplary embodiments of the disclosure

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
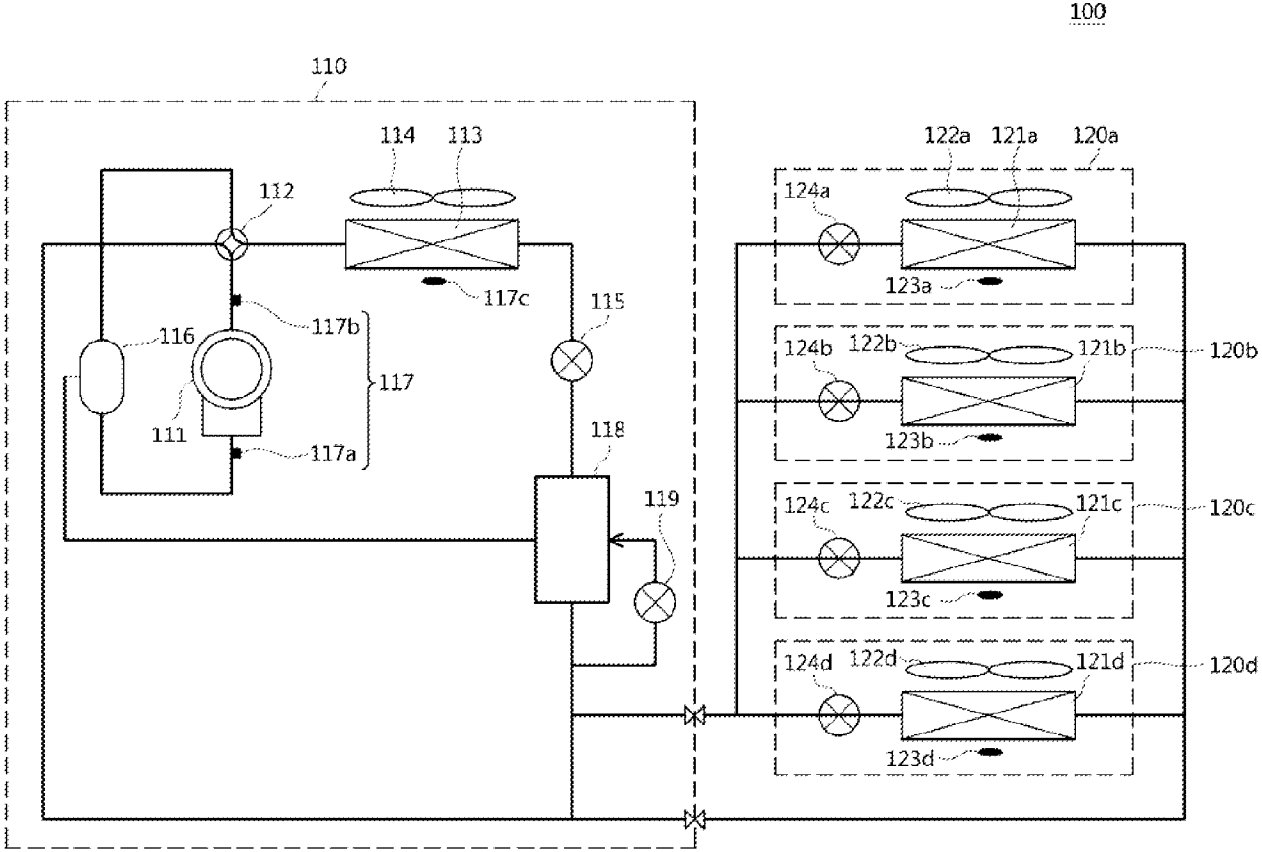
FIG. 1 is a block diagram of an air conditioner.

The present disclosure will now be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art. Like reference numerals in the drawings denote like elements, and thus their description will be omitted. In the description of the present disclosure, if it is determined that a detailed description of commonly-used technologies or structures related to the embodiments of the present disclosure may unnecessarily obscure the subject matter of the invention, the detailed description will be omitted. It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

Embodiments of the present disclosure will now be described with reference to accompanying drawings.

As an example of an air conditioner of the present disclosure, a system air conditioner including a single outdoor unit and multiple indoor units will be described below, but embodiments of the present disclosure are not limited thereto.

FIG. 1 is a block diagram of an air conditioner.

As shown in FIG. 1, an air conditioner 100 may include a single outdoor unit 110 and multiple indoor units 120*a*, 120*b*, 120*c*, and 120*d*. Although shown as having the single outdoor unit 110, it is possible for the air conditioner 100 to have multiple outdoor units.

The outdoor unit 110 may include a compressor 111, a four-way valve 112, an outdoor heat exchanger 113, an outdoor fan 114, an electronic expansion valve for heating control 115, an accumulator 116, a sensor for measuring the compressors state 117, a heat exchanger for subcooling control 118, and an electronic expansion valve for subcooling control 119.

The indoor units 120*a*, 120*b*, 120*c*, and 120*d* may include indoor heat exchangers 121*a*, 121*b*, 121*c*, and 121*d*, indoor fans 122*a*, 122*b*, 122*c*, and 122*d*, indoor temperature sensors 123*a*, 123*b*, 123*c*, and 123*d*, and indoor electronic expansion valves 124*a*, 124*b*, 124*c*, and 124*d*, respectively.

The compressor 111 may be, but not exclusively, an inverter-type compressor 111 for compressing a low-temperature low pressure refrigerant fluid and discharging it as hot-temperature high pressure refrigerant gas.

The four-way valve 112 may be operated to be turned on/off to change the refrigerant flow according to whether the operation mode selected by the user is cooling operation mode or heating operation mode. Specifically, the four-way valve 112 may have two separate paths, which enable high temperature and high pressure refrigerant gas discharged from the compressor 111 to be transferred to the indoor heat exchangers 121*a*, 121*b*, 121*c*, and 121*d* in the heating operation mode and to the outdoor heat exchanger 113 in the cooling operation mode.

The outdoor heat exchanger 113 may serve as a condenser for condensing a high pressure high temperature refrigerant gas into a high pressure room temperature fluid in the cooling operation mode, and as an evaporator for evaporating a low pressure low temperature refrigerant fluid into a gas in the heating operation mode, thereby acting to cause heat exchange with the surrounding air in response to a change in enthalpy of the refrigerant. In this regard, the outdoor heat exchanger 113 may be a main heat exchanger distinguished from the heat exchanger for subcooling control 118.

The outdoor fan 114 may play the role of catalyst for facilitating the heat exchange action between the air and the refrigerant flowing in the outdoor heat exchanger 113, thereby increasing the heat exchange ability of the outdoor unit 110.

The electronic expansion valve for subcooling control 119 may enable some of the refrigerant having passed through the heat exchanger for subcooling control 118 to be sent back to the heat exchanger for subcooling control 118 and then transferred to the accumulator 116. In this regard, the high temperature refrigerant that has passed through the outdoor heat exchanger 113 may undergo a drop in temperature while passing through the heat exchanger for subcooling control 118, and the resultant refrigerant may be transferred to the heat exchanger for subcooling control 118 through the electronic expansion valve for subcooling control 119. The heat exchanger 118 for subcooling control 118 may be a plate-type heat exchanger, but is not limited thereto.

The electronic expansion valve 119 for subcooling control 119 may be switched to various modes (e.g., On mode, Off mode, etc.) according to a control signal sent from a controller 130 as will be discussed in connection with FIG. 2.

The accumulator 116 may be installed on the suction side of the compressor 111 for changing the phase of the refrigerant inhaled to the compressor 111 into a complete form of gas.

The sensor for measuring the compressors state 117 may include a first pressure sensor 117*a* for measuring suction pressure and a second pressure sensor 117*b* for measuring discharge pressure, which are arranged on either side (i.e., on the suction side and discharge side) of the compressor 111. The suction pressure means a pressure on the suction side of the compressor 111 and the discharge pressure means a pressure of the gas discharged from the compressor 111.

The sensor for measuring the compressors state 117 may further include an outdoor temperature sensor 117*c* for measuring a saturation temperature during condensation in the outdoor heat exchange 113 and indoor temperature sensors 123*a*, 123*b*, 123*c*, and 123*d* for measuring respective saturation pressures temperatures during evaporation in respective indoor heat exchangers 121*a*, 121*b*, 121*c*, and 121*d*. A saturation temperature measured by the outdoor temperature sensor 117*c* is a temperature at a high pressure, and respective saturation temperatures of pressures measured by the respective indoor temperature sensors 123*a*, 123*b*, 123*c*, and 123*d* are temperatures at low pressures.

As opposed to the outdoor heat exchanger 113, the indoor heat exchangers 121*a*, 121*b*, 121*c*, and 121*d* may serve as evaporators during the cooling operation and as condensers during the heating operation, exchanging heat with the surrounding air.

The indoor fans 122*a*, 122*b*, 122*c*, and 122*d* may facilitate heat exchanges between the refrigerant flowing in the indoor heat exchangers 121*a*, 121*b*, 121*c*, and 121*d*, and the air and generate a cool current of air or warm current of air for indoor rooms.

The indoor temperature sensors 123*a*, 123*b*, 123*c*, and 123*d* may measure respective saturation temperatures of pressures during the evaporation operation of the respective indoor units 120*a*, 120*b*, 120*c*, and 120*d*.

The indoor electronic expansion valve 124*a*, 124*b*, 124*c*, and 124*d* may be arranged in the four indoor units 120*a*, 120*b*, 120*c*, and 120*d*, respectively.

The air conditioner 100 may change the flow of the refrigerant by switching the four-way valve 112 according to whether the operating mode selected by the user is the cooling operation mode or heating operation mode.

Figure 2:
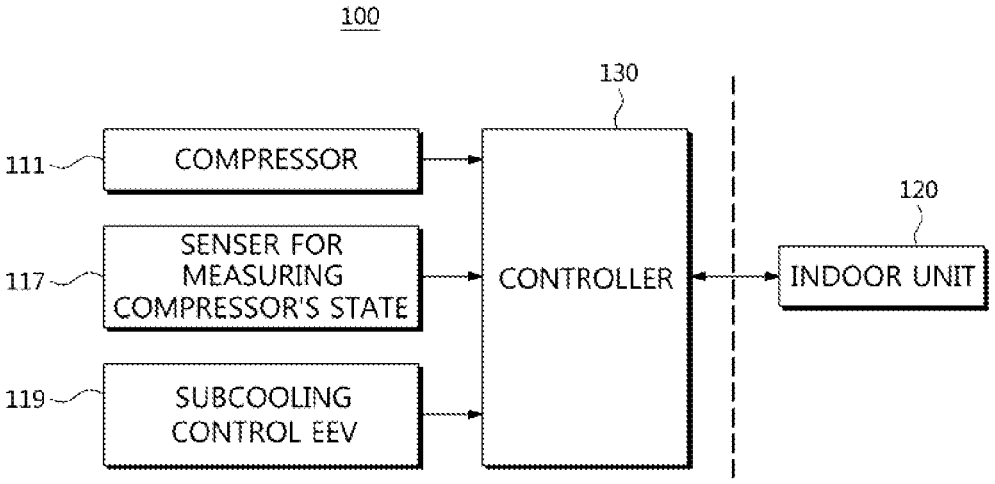
FIG. 2 is a control bock diagram of an air conditioner.
Figure 5:
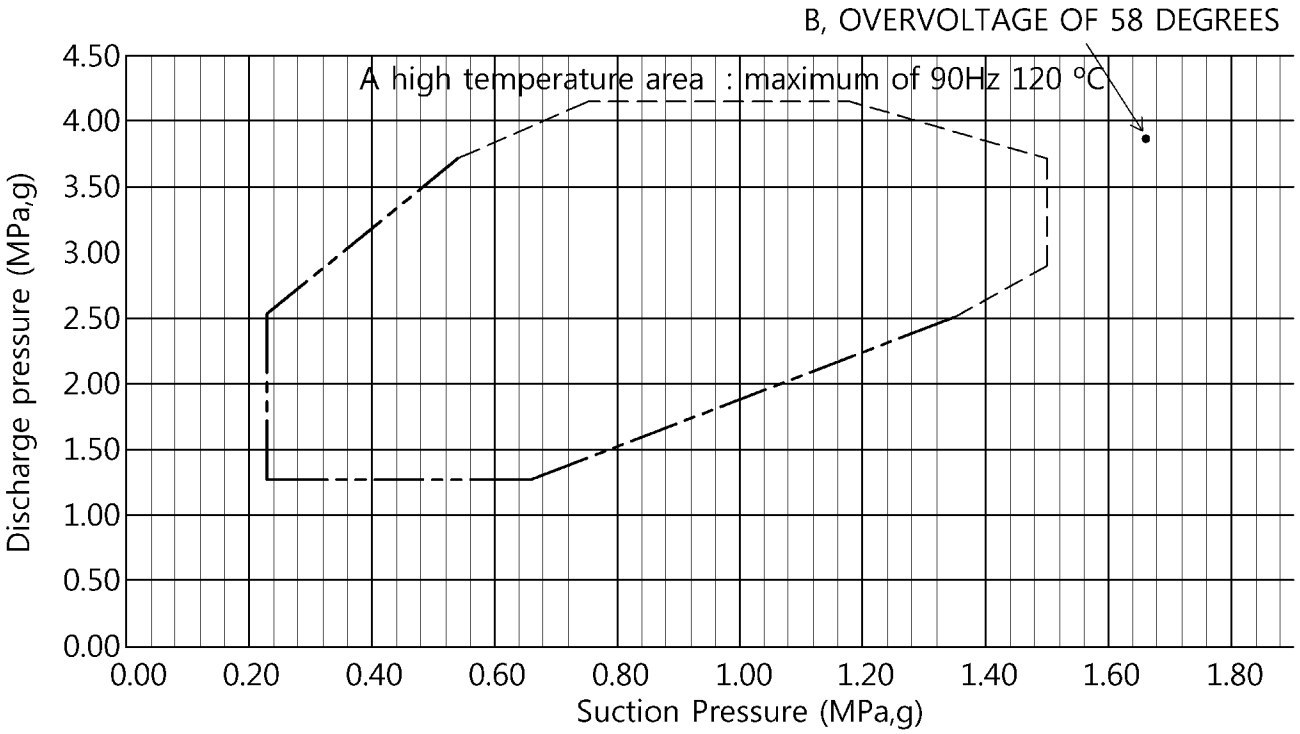
FIG. 5 is a graph representing a range of suction and discharge pressures for compressor protection control.

FIG. 2 is a control block diagram of an air conditioner, which will be described with reference to FIG. 5 showing a graph representing a range of protection control values comprised of suction and discharge pressures for compressor protection control.

The air conditioner 100 will be described by focusing on the configuration for protection control for a compressor while omitting the description of the other configurations.

As shown in FIG. 2, the air conditioner 100 may include the compressor 111, the sensor for measuring the compressors state 117, the electronic expansion valve (EEV) for subcooling control 119, the indoor unit 120, and the controller 130.

The sensor for measuring the compressors state 117 may detect compressor state information that includes at least one of a pressure value and a saturation temperature of the compressor 111.

In this regard, the sensor for measuring the compressors state 117 may detect the pressure value by measuring a suction pressure and discharge pressure of the compressor 111.

More specifically, the sensor for measuring the compressors state 117 may include the first pressure sensor 117*a* for measuring suction pressure and the second pressure sensor 117*b* for measuring discharge pressure, which are arranged on either side (i.e., on the suction side and discharge side) of the compressor 111. The suction pressure is a low pressure, and the discharge pressure is a high pressure.

The sensor for measuring the compressors state 117 may further include an outdoor temperature sensor 117*c* for measuring a saturation temperature during condensation in the outdoor heat exchange 113 and indoor temperature sensors 123*a*, 123*b*, 123*c*, and 123*d* for measuring respective saturation temperatures of pressures during evaporation in respective indoor heat exchangers 121*a*, 121*b*, 121*c*, and 121*d*, to detect respective saturation temperatures of pressures. A saturation temperature measured by the outdoor temperature sensor 117*c* is a temperature at a high pressure, and respective saturation temperatures of pressures measured by the respective indoor temperature sensors 123*a*, 123*b*, 123*c*, and 123*d* are temperatures at low pressures. The saturation temperature means a temperature corresponding to a pressure value of the compressor 111. It is possible for the saturation temperature to be set in advance by being matched per pressure values. In this case, if a pressure value of the compressor 111 is detected, the saturation temperature may be obtained by reading out a temperature stored to match the detected pressure value. On the contrary, once the saturation temperature is detected, a pressure value stored to correspond to the detected saturation temperature may be obtained. Accordingly, it may be possible to omit any of the pressure sensors (i.e., the first pressure sensor 117*a* and the second pressure sensor 117*b*) and temperature sensors (i.e., the outdoor temperature sensor 117*c* and the indoor temperature sensors 123*a*, 123*b*, 123*c*, and 123*d*).

The controller 130 may compare the compressor state information measured from the sensor for measuring the compressors state 117 with a threshold, and accordingly control the air flow on the side of the indoor unit.

More specifically, the controller 130 may compare the pressure value of the compressor measured from the sensor for measuring the compressors state 117 with a pressure threshold, and accordingly control the air flow on the side of the indoor unit. The air flow on the side of the indoor unit may include a user-set air flow manipulated by the user and an initially-set air flow set in initially setting the indoor unit. The initially-set air flow may refer to not only the air flow set in initially setting the indoor unit 120 but also air flow set for safety of the indoor unit 120, and may be distinguished from the user-set air flow set by the user manipulating an input button.

The controller 130 may control at least one of the user-set air flow and initially-set air flow in regulating the air flow on the side of the indoor unit. In other words, the controller 130 may only control the user-set air flow set by manipulation of the user for the air conditioner 100, may only control the initially-set air flow set for the air conditioner 100 by an operator, or may control both the user-set air flow and the initially-set air flow, in regulating the air flow on the side of the indoor unit.

The pressure threshold is set based on a range of protection control values for protecting the compressors 111 performance, and the range of protected control values may be represented by an area encircled by a solid or dashed line, as shown in FIG. 5. The range of the protection control values may be defined as a range of pressure values that may protect the compressors performance in good state.

For example, the pressure threshold may be set to be in a dangerous range if exceeding 1.5 MPa, g with respect to the suction pressure, and 1.4 MPa, g of the pressure threshold with respect to the suction pressure may be set to be in a normal but maintenance range to further check the state of the compressor 111 in a phase of entering the normal range from the dangerous range. However, the pressure threshold is not limited thereto, but may vary by an operator.

The controller 130 may be further configured to control not only the air flow on the side of the indoor unit but also the subcooling control mode based on a result of comparing the compressor state information (e.g., a pressure value or saturation temperature of the compressor 111) and the threshold (e.g., pressure threshold or temperature threshold). The subcooling control means to control a subcooling degree by controlling the electronic expansion valve for subcooling control 119 and an Enhanced Vapor Injection (EVI) bypass (not shown).

More specifically, the controller 130 may adjust the air flow on the side of the indoor unit to a necessary air flow for now and turn off the subcooling control mode, if the pressure value of the compressor 111 has exceeded a first pressure threshold in the dangerous range for a predetermined time. The necessary air flow may be defined as air flow required for the pressure value of the compressor 111 to reach the normal range. Turning off the subcooling control mode means to regulate the electronic expansion valve for subcooling control 119 to 0 step and control the subcooling degree by opening the EVI bypass, during operation.

Referring to FIG. 5, the pressure value of the compressor 111 may be a value comprised of a suction pressure value and a discharge pressure value. The dangerous range may refer to a pressure range that may affect degradation of the compressor's 111 performance.

For example, if a pressure value of the compressor 111 is in overvoltage state of 58 degrees, as shown as point "B" in FIG. 5, the controller 130 may determine that the compressor 111 is in the dangerous state, send the indoor unit 120 a control signal to control the air flow on the side of the indoor unit 120 to be low, and turn off the subcooling control mode. In this regard, the air flow on the side of the indoor unit is not exclusively regulated to the low level but to any level for the pressure value of the compressor 111 to enter the normal range.

If the pressure value of the compressor 111 has been less than a second pressure threshold in the maintenance range for a predetermined time since the controller 130 controlled the air flow on the side of the indoor unit to be the necessary air flow for now and turned off the subcooling control mode, the controller 130 may control the air flow on the side of the indoor unit to be the set air flow and keep on turning off the subcooling control mode (that is, maintain the subcooling control mode to be off). The maintenance range may refer to a mid range between the normal range and the dangerous range that may affect degradation of the compressor's 111 performance, in which it is determined that the pressure value of the compressor 111 deviates from the normal range but has not fully entered the normal range. Controlling the air flow on the side of the indoor unit to the set air flow means to return to the user-set air flow before the compressor protection mode was operated and the initially-set air flow set during initial setting of the indoor unit 120. For example, it may mean to control the air flow on the indoor side to be higher than the current air flow.

If the pressure value of the compressor 111 has been less than a third pressure threshold in the normal range for a predetermined time since the controller 130 controlled the air flow on the side of the indoor unit to be the set air flow and kept on turning off the subcooling control mode, the controller 130 may turn on the subcooling control mode. The normal range may refer to a range of pressure values that may maintain the compressors performance in good state. Turning on the subcooling control mode means to control the subcooling degree by opening the electronic expansion valve for subcooling control 119 and EVI bypass during operation.

FIG. 5 is a graph representing a range of protection control values for compressor envelope protection control, in which 'A' represents a range of protection control values including a high temperature region. If the pressure value of the compressor 111 exceeds a pressure threshold and deviates from the range of protection control values, as represented by point B (58-degree overvoltage), the controller 130 may enable the compressor 111 to be operated within the range of protection control values by changing the air flow on the side of the indoor unit and mode of the electronic expansion valve for subcooling control 119.

In the meantime, the controller 130 may compare the saturation temperature measured from the sensor for measuring the compressors state 117 with a temperature threshold, and accordingly control the air flow on the side of the indoor unit. The temperature threshold may be a value of a saturation temperature corresponding to a pressure value with respect to the range of protection control values for protecting the compressors 111 performance.

The controller 130 may be further configured to control not only the air flow on the side of the indoor unit but also the subcooling control mode according to a result of comparing the saturation temperature with the temperature threshold. The subcooling control means to control a subcooling degree by controlling the electronic expansion valve for subcooling control 115 and an EVI bypass (not shown).

More specifically, the controller 130 may adjust the air flow on the side of the indoor unit to necessary air flow for now and turn off the subcooling control mode, if the saturation temperature of the compressor 111 has exceeded a first temperature threshold in the dangerous range for a predetermined time. The necessary air flow may be defined as air flow required for the pressure value of the compressor 111 corresponding to the saturation temperature to reach the normal range. Turning off the subcooling control mode means to regulate the electronic expansion valve for subcooling control 119 to 0 step and control the subcooling degree by opening the EVI bypass, during operation. The dangerous range refers to a pressure range that may affect degradation of the compressors 111 performance, and the first temperature threshold may refer to a temperature value corresponding to a pressure in the dangerous range.

If the saturation temperature has been less than a second temperature threshold in the maintenance range for a predetermined time since the controller 130 controlled the air flow on the side of the indoor unit to be the necessary air flow for now and turned off the subcooling control mode, the controller 130 may control the air flow on the side of the indoor unit to be the set air flow and keep on turning off the subcooling control mode.

The maintenance range may refer to a mid range between the normal range and the dangerous range that may affect degradation of the compressors 111 performance, in which it is determined that the saturation temperature deviates from the dangerous pressure range but has not fully entered the normal range.

Controlling the air flow on the side of the indoor unit to the set air flow means to return to the user-set air flow before the compressor protection mode was operated and the initially-set air flow set during initial setting of the indoor unit 120. For example, it may mean to control the air flow on the indoor side to be higher than the current air flow.

If the saturation temperature has been less than a third temperature threshold in the normal range for a predetermined time since the controller 130 controlled the air flow on the side of the indoor unit to be the set air flow and kept on turning off the subcooling control mode, the controller 130 may turn on the subcooling control mode. The normal range may refer to a range of pressure values that may maintain the compressor's performance in good state. Turning on the subcooling control mode means to control the subcooling degree by opening the electronic expansion valve for subcooling control 119 and EVI bypass during operation.

The controller 130 may be included on the side of the outdoor unit, but is not limited thereto. Of course, the controller 130 may include functions to control the air flow on the side of the indoor unit. The controller 130 may switch the mode of indoor fans 122*a*, 122*b*, 122*c*, and 122*d* on the side of the indoor unit 120 by sending the indoor unit 120 a signal to control the air flow on the side of the indoor unit 120.

Figure 3:
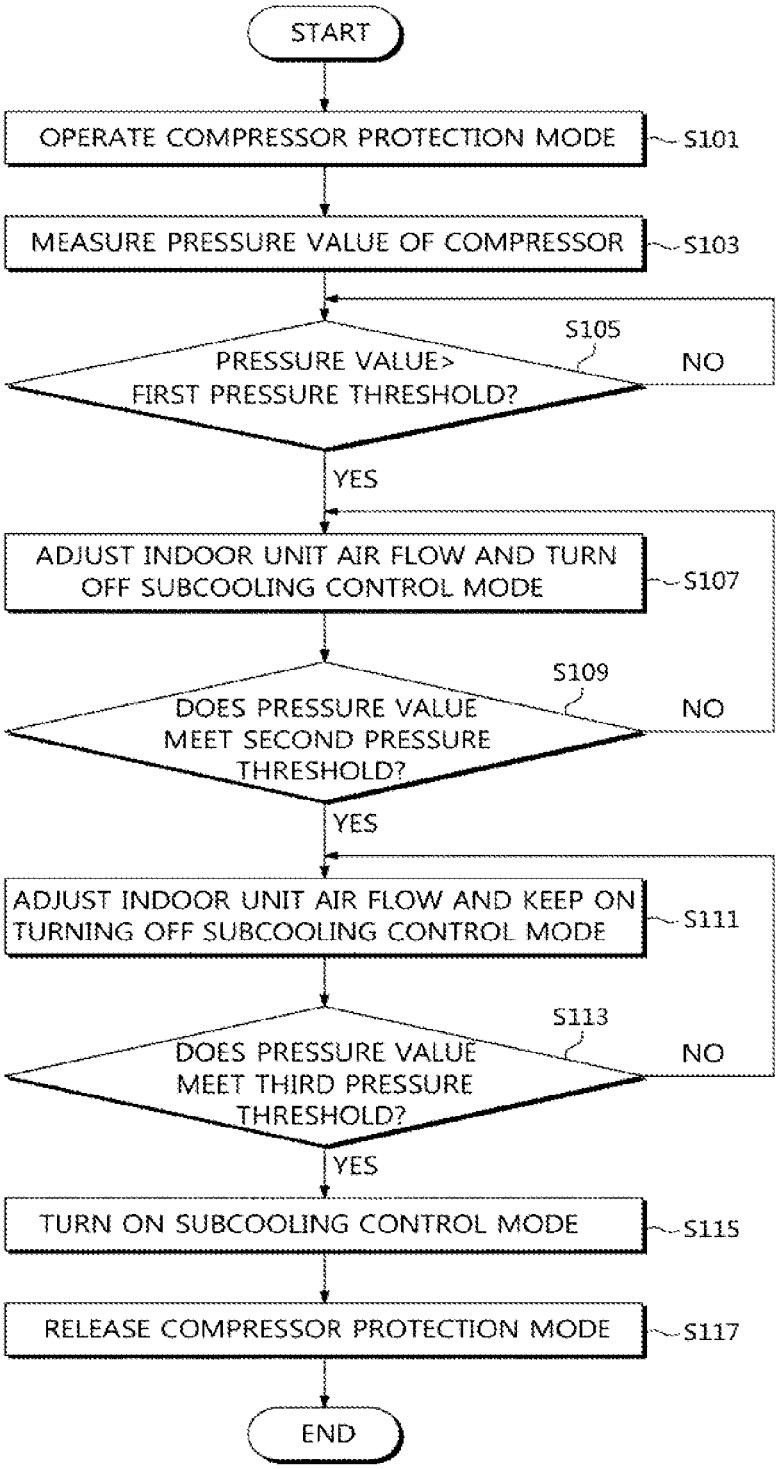
FIG. 3 is a flowchart illustrating a method for controlling an air conditioner, according to an embodiment of the present disclosure.

FIG. 3 is a flowchart illustrating a method for controlling an air conditioner, according to an embodiment of the present disclosure, which will be described with reference to FIG. 5 showing a graph representing a range of suction pressure and discharge pressure for compressor protection control.

First, in operation S101, the air conditioner 100 operates compressor protection mode. The compressor protection mode may be manually selected by the user selecting a separate button, or may be automatically selected by being matched to a particular condition set for the air conditioner 100.

In operation S103, the air conditioner 100 may detect a pressure value by measuring suction pressure and discharge pressure of the compressor 111.

The air conditioner 100 may then compare the pressure value of the compressor 111 with a pressure threshold and accordingly control air flow on the side of the indoor unit. The air flow on the side of the indoor unit may include a user-set air flow manipulated by the user and an initially-set air flow set in initially setting the indoor unit. The initially-set air flow may refer to not only the air flow set in initially setting the indoor unit 120 but also air flow set for safety of the indoor unit 120, and may be distinguished from the user-set air flow set by the user manipulating an input button. The controller 130 of the air conditioner 100 may control at least one of the user-set air flow and initially-set air flow in regulating the air flow on the side of the indoor unit. In other words, the controller 130 may only control the user-set air flow set by manipulation of the user for the air conditioner 100, may only control the initially-set air flow set for the air conditioner 100 by an operator, or may control both the user-set air flow and the initially-set air flow, in regulating the air flow on the side of the indoor unit.

The pressure threshold is set based on the range of protection control values for protecting the compressors 111 performance, and the range of protected control values may be represented by an area encircled by a solid or dashed line, as shown in FIG. 5. The range of the protection control values may be defined as a range of pressure values that may protect the compressors performance in good state.

For example, the pressure threshold may be set to be in a dangerous range if exceeding 1.5 MPa, g with respect to the suction pressure, and 1.4 MPa, g of the pressure threshold with respect to the suction pressure may be set to be in a normal but maintenance range to further check the state of the compressor 111 in a phase of entering the normal range from the dangerous range. However, the pressure threshold is not limited thereto, but may vary by an operator.

In the meantime, the air conditioner 100 may also control subcooling mode according to a result of comparing the pressure value of the compressor and the pressure threshold while controlling the air flow on the side of the indoor unit.

The subcooling control means to control a subcooling degree by controlling the electronic expansion valve for subcooling control 119 and an EVI bypass (not shown).

More specifically, in operation S105, the air conditioner 100 may determine whether the pressure value of the compressor 111 has exceeded the first pressure threshold in the dangerous range for a predetermined time.

If it is determined that the pressure value of the compressor 111 has exceeded the first pressure threshold for the predetermined time, the air conditioner 100 may adjust the air flow on the side of the indoor unit to a necessary air flow for now and turn off the subcooling control mode, in operation S107. At this time, it may be possible for the air conditioner 100 to adjust only the air flow on the side of the indoor unit.

The necessary air flow may be defined as air flow required for the pressure value of the compressor 111 to reach the normal range. Turning off the subcooling control mode means to regulate the electronic expansion valve for subcooling control 119 to 0 step and control the subcooling degree by opening the EVI bypass during operation.

In operation S109, the air conditioner 100 may determine whether the pressure value of the compressor 111 has been less than a second pressure threshold in a maintenance range for a predetermined time. The maintenance range may refer to a mid range between the dangerous range that may affect degradation of the compressor's 111 performance and the normal range, in which it is determined that the pressure value of the compressor 111 deviates from the normal range but has not fully entered the normal range.

If it is determined that the pressure value of the compressor 111 has been less than the second pressure threshold for the predetermined time, the air conditioner 100 may adjust the air flow on the side of the indoor unit to a set air flow and keep on turning off the subcooling control mode, in operation S111. Controlling the air flow on the side of the indoor unit to the set air flow means to return to the user-set air flow before the compressor protection mode was operated and the initially-set air flow set during initial setting of the indoor unit 120. For example, it may mean to control the air flow on the indoor side to be higher than the current air flow.

In operation S113, the air conditioner 100 may determine whether the pressure value of the compressor 111 has been less than a third pressure threshold in a normal range for a predetermined time.

If it is determined that the pressure value of the compressor 111 has been less than the third pressure threshold for the predetermined time, the air conditioner 100 may turn on the subcooling control mode and release the compressor protection mode in operations S115 and S117. Turning on the subcooling control mode means to control the subcooling degree by opening the electronic expansion valve for subcooling control 119 and EVI bypass during operation.

Figure 4:
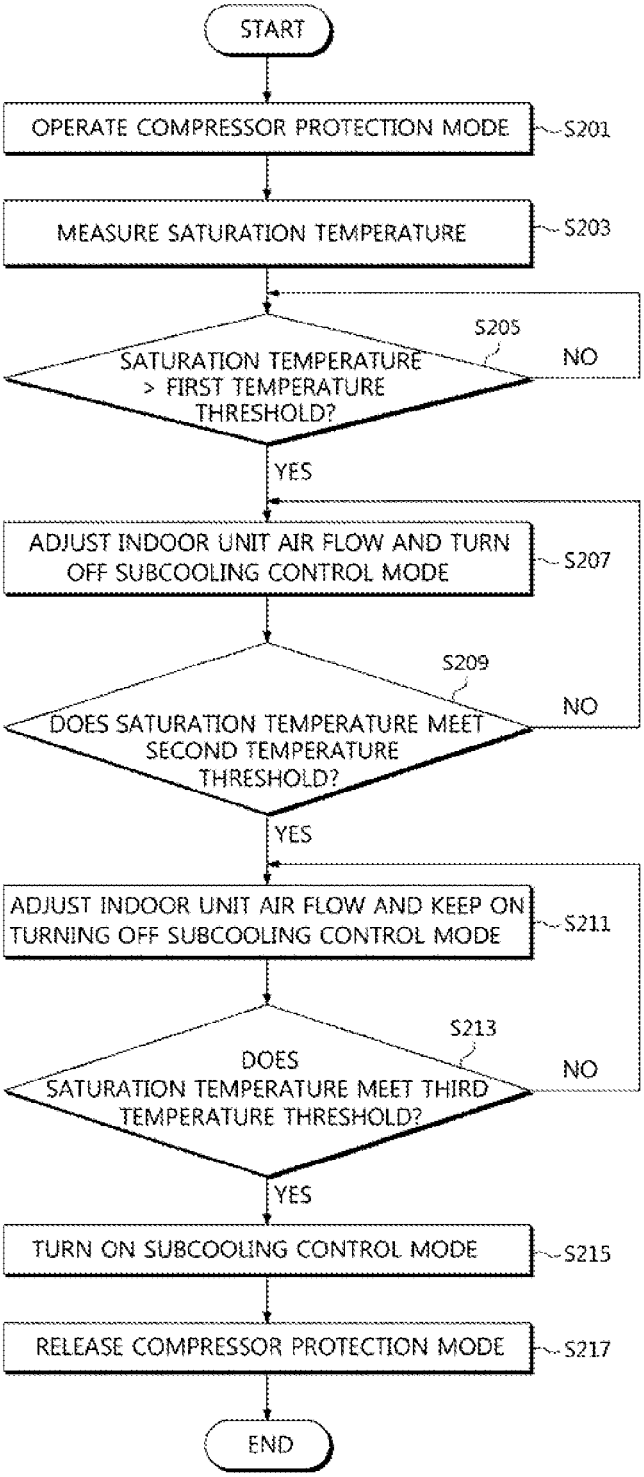
FIG. 4 is a flowchart illustrating a method for controlling an air conditioner, according to another embodiment of the present disclosure.

FIG. 4 is a flowchart illustrating a method for controlling an air conditioner, according to another embodiment of the present disclosure.

First, in operation S201, the air conditioner 100 operates compressor protection mode. The compressor protection mode may be manually selected by the user selecting a separate button, or may be automatically selected by being matched to a particular condition set for the air conditioner 100.

In operation S203, the air conditioner 100 may detect a saturation temperature.

The saturation temperature may refer to one measured from the outdoor temperature sensor 140 during condensation or others measured from indoor temperature sensors 123*a*, 123*b*, 123*c*, and 123*d* during evaporation, which corresponds to the pressure value of the compressor 111.

The air conditioner 100 may then compare the saturation temperature with a saturation temperature threshold and accordingly control air flow on the side of the indoor unit. The air flow on the side of the indoor unit may include a user-set air flow manipulated by the user and an initially-set air flow set in initially setting the indoor unit. The initially-set air flow may refer to not only the air flow set in initially setting the indoor unit 120 but also air flow set for safety of the indoor unit 120, and may be distinguished from the user-set air flow set by the user manipulating an input button. The controller 130 of the air conditioner 100 may control at least one of the user-set air flow and initially-set air flow in regulating the air flow on the side of the indoor unit. In other words, the controller 130 may only control the user-set air flow set by manipulation of the user for the air conditioner 100, may only control the initially-set air flow set for the air conditioner 100 by an operator, or may control both the user-set air flow and the initially-set air flow, in regulating the air flow on the side of the indoor unit.

Furthermore, the saturation temperature threshold may be set based on a saturation temperature corresponding to a pressure value in a range of protection control values for protecting the compressors 111 performance. The range of the protection control values may be defined as a range of pressure values that may protect the compressors performance in good state.

In the meantime, the air conditioner 100 may also control subcooling mode according to a result of comparing the saturation temperature and the saturation temperature threshold in controlling the air flow on the side of the indoor unit. The subcooling control means to control a subcooling degree by controlling the electronic expansion valve for subcooling control 119 and an EVI bypass (not shown).

More specifically, in operation S205, the air conditioner 100 may determine whether the saturation temperature has exceeded a first temperature threshold in a dangerous range for a predetermined time.

If it is determined that the saturation temperature has exceeded the first temperature threshold for the predetermined time, the air conditioner 100 may adjust the air flow on the side of the indoor unit to necessary air flow for now and turn off the subcooling control mode, in operation S207. At this time, it may be possible for the air conditioner 100 to adjust only the air flow on the side of the indoor unit.

The necessary air flow may be defined as air flow required for the pressure value of the compressor 111 corresponding to the saturation temperature to reach the normal range.

Turning off the subcooling control mode means to regulate the electronic expansion valve for subcooling control 119 to 0 step and control the subcooling degree by opening the EVI bypass during operation.

In operation S209, the air conditioner 100 may determine whether the saturation temperature has been less than a second temperature threshold in a maintenance range for a predetermined time. The maintenance range may refer to a mid range between the normal range and the dangerous range that may affect degradation of the compressor's 111 performance, in which it is determined that the saturation temperature deviates from the dangerous pressure range but has not fully entered the normal range.

If it is determined that the saturation temperature has been less than the second temperature threshold for the predetermined time, the air conditioner 100 may adjust the air flow on the side of the indoor unit to a set air flow and keep on turning off the subcooling control mode, in operation S211. Controlling the air flow on the side of the indoor unit to the set air flow means to return to the user-set air flow before the compressor protection mode was operated and the initially-set air flow set during initial setting of the indoor unit 120. For example, it may mean to control the air flow on the indoor side to be higher than the current air flow.

In operation S213, the air conditioner 100 may determine whether the saturation temperature has been less than a third temperature threshold in a normal range for a predetermined time.

If it is determined that the saturation temperature has been less than the third temperature threshold for the predetermined time, the air conditioner 100 may turn on the subcooling control mode and release the compressor protection mode in operations S215 and S217. Turning on the subcooling control mode means to control the subcooling degree by opening the electronic expansion valve for subcooling control 119 and EVI bypass during operation.

In typical compressor control, frequency or varying capacity of the compressor may be controlled to be reduced without controlling other factors. Especially, under high temperature conditions, an air conditioner like a system air conditioner is operated such that frequency or capacity of the compressor may be reduced to its minimum since the saturation temperature is high due to the surrounding temperature. However, as the compressor reaches the hardware limit, the compressor may be operated out of a range of protection control values, thereby reducing the reliability of the compressor.

In accordance with embodiments of the present disclosure, adjusting the air flow on the side of an indoor unit based on the range of protection control values for the compressor in the compressor protection control mode may increase the reliability of the compressor and a customers satisfaction in the product in a high temperature region. Since measurements of the compressors low pressure range depend on installation rate of indoor unit, an air conditioner in accordance with embodiments of the present disclosure may have an advantage of controlling the compressors performance according to the installation rate of indoor rate. In other words, in accordance with embodiments of the present disclosure, in operation of the compressor under high temperature conditions, having the compressor operate in a range of protection control values may increase the reliability of the compressor. Furthermore, in accordance with embodiments of the present disclosure, adjusting the air flow of an indoor unit based on an operation range may enable the operation range to be expanded and enable continuous operation.

Various operations are described herein as being performed by the controller 130. The controller 130 may include, for example, a memory storing computer-executable instructions, and a computer processor to execute the instructions stored in the memory, to thereby perform the operations. However, the controller 130 is not limited to including any specific components, or to any specific structure or configuration.

According to the embodiments of the present disclosure, regulating air flow on the side of an indoor unit by taking into account a pressure range of a compressor during protection control of the compressor may increase reliability of the compressor and controlling the air conditioner actively may expand its operating range, thereby increasing the users feeling of satisfaction with the air conditioner.

Several embodiments have been described, but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

What is claimed is:

1. An air conditioner comprising:

a compressor;

a sensor configured to detect compressor state information that includes at least one of a pressure value and a saturation temperature of the compressor;

an electronic expansion valve for a subcooling control;

an enhanced vapor injection bypass; and a controller configured to control air flow on a side of an indoor unit of the air conditioner by comparing the compressor state information detected by the sensor and a threshold, wherein the controller is configured to adjust the air flow on the side of the indoor unit to a necessary air flow and turn off a subcooling control mode, if the pressure value of the compressor has exceeded a first pressure threshold in a dangerous range for a predetermined time, and wherein the subcooling control mode is a mode for controlling a subcooling degree by controlling the electronic expansion valve and the enhanced vapor injection bypass.

2. The air conditioner of claim 1, wherein the controller is further configured to control the subcooling control mode of the air conditioner according to a result of the comparing the compressor state information and the threshold.

3. The air conditioner of claim 2, wherein the compressor state information detected by the sensor includes the pressure value of the compressor, the sensor detects the pressure value of the compressor by measuring suction pressure and discharge pressure of the compressor, and the controller is further configured to control the air flow on the side of the indoor unit by comparing the pressure value of the compressor detected by the sensor with a pressure threshold.

4. The air conditioner of claim 2, wherein the compressor state information detected by the sensor includes the saturation temperature, and the controller is configured to control the air flow on the side of the indoor unit by comparing the saturation temperature detected by the sensor with a temperature threshold.

5. The air conditioner of claim 4, wherein the controller is configured to adjust the air flow on the side of the indoor unit to a necessary air flow and turn off the subcooling control mode, if the saturation temperature has exceeded a first temperature threshold in a dangerous range for the predetermined time.

6. The air conditioner of claim 5, wherein the controller is configured to adjust the air flow on the side of the indoor unit to a set air flow and maintain the subcooling control mode to be off, if the saturation temperature has been less than a second temperature threshold in a maintenance range for a predetermined time since the air flow on the side of the indoor unit was adjusted to the necessary air flow and the subcooling control mode was turned off.

7. The air conditioner of claim 6, wherein the controller is configured to turn on the subcooling control mode, if the saturation temperature has been less than a third temperature threshold in a normal range for a predetermined time since the air flow on the side of the indoor unit was adjusted to the set air flow and the subcooling control mode was maintained to be off.

8. The air conditioner of claim 1, wherein the controller is configured to adjust the air flow on the side of the indoor unit to a set air flow and to maintain the subcooling control mode to be off, if the pressure value of the compressor has been less than a second pressure threshold in a maintenance range for a predetermined time since the air flow on the side of the indoor unit was adjusted to the necessary air flow and the subcooling control mode was turned off.

9. The air conditioner of claim 8, wherein the controller is configured to turn on the subcooling control mode, if the pressure value of the compressor has been less than a third pressure threshold in a normal range for a predetermined time since the air flow on the side of the indoor unit was adjusted to the set air flow and the subcooling control mode was maintained to be off.

10. The air conditioner of claim 1, wherein the air flow on the side of the indoor unit comprises a user-set air flow manipulated by a user and an initially-set air flow set in initially setting the indoor unit, and the controller is configured to control at least one of the user-set air flow and the initially-set air flow in regulating the air flow on the side of the indoor unit.

11. The air conditioner of claim 1, wherein the compressor is included in an outdoor unit of the air conditioner.

12. A method of controlling an air conditioner, the method comprising:

detecting compressor state information that includes at least one of a pressure value and a saturation temperature of a compressor of the air conditioner; and controlling air flow on a side of an indoor unit of the air conditioner by comparing the compressor state information with a threshold, wherein:

the detected compressor state information includes the pressure value of the compressor, the detecting detects the pressure value of the compressor by measuring suction pressure and discharge pressure of the compressor, and the controlling the air flow on the side of the indoor unit comprises:

determining whether the pressure value of the compressor has exceeded a first pressure threshold in a dangerous range for a predetermined time, and adjusting the air flow on the side of the indoor unit to a necessary air flow and turning off a subcooling control mode, if it is determined by the determining that the pressure value of the compressor has exceeded the first pressure threshold for the predetermined time, wherein the subcooling control mode is a mode for controlling a subcooling degree by controlling an electronic expansion valve and an enhanced vapor Injection bypass.

13. The method of claim 12, wherein the controlling air flow on the side of the indoor unit comprises:

controlling the subcooling control mode of the air conditioner according to a result of the comparing the compressor state information and the threshold.

14. The method of claim 13, wherein the compressor state information includes the saturation temperature, and the controlling the air flow on the side of the indoor unit comprises:

determining whether the saturation temperature has exceeded a first temperature threshold in a dangerous range for a predetermined time, and adjusting the air flow on the side of the indoor unit to a necessary air flow and turning off the subcooling control mode, if it is determined by the determining that the saturation temperature has exceeded the first temperature threshold for the predetermined time.

15. The method of claim 14, wherein the controlling the air flow on the side of the indoor unit further comprises:

after adjusting the air flow on the side of the indoor unit to a necessary air flow and turning off the subcooling control mode, determining whether the saturation temperature has been less than a second temperature threshold in a maintenance range for a predetermined time, and adjusting the air flow on the side of the indoor unit to a set air flow and the subcooling control mode to be off, if it is determined by the determining whether the saturation temperature has been less than the second temperature threshold that the saturation temperature has been less than the second temperature threshold for the predetermined time.

16. The method of claim 15, wherein the controlling the air flow on the side of the indoor unit further comprises:

after adjusting the air flow on the side of the indoor unit to the set air flow and maintaining the subcooling control mode to be off, determining whether the saturation temperature has been less than a third temperature threshold in a normal range for a predetermined time, and turning on the subcooling control mode, if it is determined by the determining whether the saturation temperature has been less than the third temperature that the saturation temperature has been less than the third temperature threshold for the predetermined time.

17. The method of claim 12, wherein the controlling the air flow on the side of the indoor unit further comprises:

after adjusting the air flow on the side of the indoor unit to a necessary air flow and turning off the subcooling control mode, determining whether the pressure value of the compressor has been less than a second pressure threshold in a maintenance range for a predetermined time, and adjusting the air flow on the side of the indoor unit to a set air flow and maintaining the subcooling control mode to be off, if it is determined by the determining whether the pressure value of the compressor has been less than the second pressure threshold that the pressure value of the compressor has been less than the second pressure threshold for the predetermined time.

18. The method of claim 17, wherein the controlling the air flow on the side of the indoor unit further comprises:

after adjusting the air flow on the side of the indoor unit to the set air flow and maintaining the subcooling control mode to be off, determining whether the pressure value of the compressor has been less than a third pressure threshold in a normal range for a predetermined time, and turning on the subcooling control mode, if it is determined by the determining whether the pressure value has been less than the third pressure threshold that the pressure value of the compressor has been less than the third pressure threshold for the predetermined time.

19. The method of claim 12, wherein the air flow on the side of the indoor unit comprises a user-set air flow manipulated by a user and an initially-set air flow set in initially setting the indoor unit, and the controlling air flow on the side of the indoor unit comprises controlling at least one of the user-set air flow and initially-set air flow in regulating the air flow on the side of the indoor unit.

20. The method of claim 12, wherein the compressor is included in an outdoor unit of the air conditioner.

21. An air conditioner comprising:

an outdoor unit including a compressor;

a sensor configured to detect at least one of a pressure value and a saturation temperature of the compressor;

a plurality of indoor units;

an electronic expansion valve for a subcooling control;

an enhanced vapor injection bypass; and a controller configured to control air flow in at least one indoor unit of the plurality of indoor units by comparing the at least one of the pressure value and the saturation temperature of the compressor detected by the sensor with a threshold, wherein the controller is configured to adjust the air flow on the side of the indoor unit to a necessary air flow and turn off a subcooling control mode, if the pressure value of the compressor has exceeded a first pressure threshold in a dangerous range for a predetermined time, and wherein the subcooling control mode is a mode for controlling a subcooling degree by controlling the electronic expansion valve and the enhanced vapor Injection bypass.

* * * * *